US006523806B2

(12) United States Patent
Bartal

(10) Patent No.: US 6,523,806 B2
(45) Date of Patent: Feb. 25, 2003

(54) WINCH MOUNT

(76) Inventor: Yair Bartal, Haprachim 23, Moshav Rishpon (IL)

( * ) Notice: Subject to any disclaimer, the term of this patent is extended or adjusted under 35 U.S.C. 154(b) by 0 days.

(21) Appl. No.: 09/793,884

(22) Filed: Feb. 28, 2001

(65) Prior Publication Data

US 2002/0117654 A1 Aug. 29, 2002

(51) Int. Cl.[7] ..... B66D 1/00

(52) U.S. Cl. ..... 254/323; 254/272; 254/332; 414/466

(58) Field of Search ..... 254/323, 272, 254/328, 329, 332; 414/465, 466

(56) References Cited

U.S. PATENT DOCUMENTS 3,524,606 A * 8/1970 Coski ..... 242/484
3,690,409 A * 9/1972 Brauss ..... 182/142
3,788,605 A * 1/1974 Johnson ..... 251/166
4,331,323 A * 5/1982 Sekimori et al. ..... 242/390.8
5,207,552 A * 5/1993 Mummert ..... 192/99 S
5,215,272 A * 6/1993 Sauber ..... 242/364
5,522,582 A * 6/1996 Dilks ..... 242/587.2
5,579,710 A * 12/1996 Piesinger ..... 114/230.22
5,636,648 A * 6/1997 O'Brien et al. ..... 134/107
5,876,019 A * 3/1999 Morrissey et al. ..... 254/323
5,913,507 A 6/1999 Lauricella, Jr.
6,138,992 A 10/2000 Bell
6,189,866 B1 * 2/2001 Harkins et al. ..... 212/176
6,386,514 B1 * 5/2002 Ray ..... 254/323

* cited by examiner

*Primary Examiner*—Emmanuel Marcelo
(74) *Attorney, Agent, or Firm*—Mark M. Friedman

(57) ABSTRACT

In order to increase winch safety, power and utility method for using a winch and a method for mounting a winch based on ensuring that the force exerted by the winch cable on the drum rotation axis and the drum rotation axis remains perpendicular throughout winch operation are disclosed. An improved winch mount which allows the user of the winch to ensure that the force exerted by the winch cable on the drum rotation axis and the drum rotation axis remains perpendicular throughout winch operation is disclosed.

27 Claims, 12 Drawing Sheets

WINCH MOUNT

FIELD AND BACKGROUND OF THE INVENTION

The present invention relates generally to winches and, more particularly, to an improved method for using and mounting a winch.

Motor vehicles traveling on non-hardened surfaces often get bogged down, particularly in mud, snow, sand or rock-filled terrain. To allow the driver of the vehicle to extricate the vehicle and to continue travel without outside assistance, motor vehicles designed for travel on non-hardened surfaces are often equipped with a winch, most often attached to the front of the vehicle. When needed, the cable of the winch is attached to a fixed object such as a tree or a large stone and the winch is activated to pull the vehicle out of the terrain in which it is bogged down.

Due to the availability of electricity in motor vehicles and the technical case with which it can be utilized, electrical-power motorized winches are often used. Mechanical-power winches directly coupled to the vehicle motor (power take-off) or equipped with a dedicated internal combustion motor or hydraulic-power winches with power supplied by the power-steering pump of the vehicle are also common.

As illustrated in FIG. 1, winch 10 is typically mounted on vehicle 12 so that drum rotation axis 14 is parallel to an underlying surface 16 on which vehicle 12 rests and perpendicular to the main vehicle axis 18. Often a slot-shaped cable guide 20, known as a fairlead, is attached in front of winch 10 to guide cable 22.

Due to engineering constraints, the maximum number of wraps of cable on a winch drum is limited so that the full length of cable can be wound onto the drum only if each wrap is tightly wound and complete. When the winch cable is attached to an object substantially directly in front or behind the vehicle and the winch is activated, the drum rotates, winding the cable and pulling the vehicle. In FIG. 2*a,* cable 24 being wound is initially positioned next to or just above an immediately previously wound length of cable 26 on a winch drum 28. Due to the thickness and the substantially round cross section of cable 24, cable 24 slips downwards (FIG. 2*b*) and in this manner is wound onto drum 28 tightly against the immediately previously wound length of cable 26. When cable 24 reaches one end of the drum, a wrap is complete. The following length of cable 30 cannot slip downwards, so a new wrap is initiated (FIG. 2*c*). Thus, when the winch cable is attached to an obstacle substantially directly in front or behind the vehicle, the cable is tightly wound onto the drum.

It can happen that the winch cable is attached to an object so that the winch cable emerges from the fairlead at a significant sidewards angle, either initially or due to slipping of the vehicle during the pulling activity. Here, "significant sidewards angle" means from about 2° left or rightwards. Since a winch is typically mounted perpendicularly to the main axis of the vehicle it can be said that the cable is connected to an object that is off-axis relative to the vehicle, that is, it is not found along the axis of the vehicle.

If this angle is in the direction away from the immediately previously wound length of cable, FIG. 3*a,* new lengths of cable 32 are wound with spaces 34 between the wound lengths of cable 32. If the angle is in the direction towards the immediately previously wound length of cable, FIG. 3*b,* newly wound lengths of cable 36 climb onto the previously wound length of cable 38 despite not having completed a wrap.

Improper winding is undesirable. Since the wraps are incomplete and not tightly wound, the full length of cable cannot be utilized to extricate the vehicle. Furthermore, it is well known to one skilled in the art that if the cable climbs onto a previously wound lengths of cable the torque, and thus the power exerted by the winch through the cable, is reduced. It is thus preferable to wind wraps tightly to maintain the maximal torque for as long as possible.

Improper winding is also dangerous. While it is being improperly wound, the cable can extend outside its designed volume and cause serious damage to the winch housing or parts of the vehicle such as the fender. If the cable climbs onto an incomplete or not tightly-wound wrap, the force applied by the newly wound cable on the wrap may force the cable down into the spaces of the wrap. This damages the cable, leading to internal fraying or caging. Once damaged, it is dangerous to use the cable as it may knick or tear. Furthermore, since the price of a cable can reach 15% of the price of a winch, frequent cable replacement is economically undesirable.

In order to avoid cable damage, extrication of one vehicle often requires the assistance of an additional vehicle.

It would be advantageous to be able to use a winch when the cable is attached to an object so that the cable extends at a significantly sidewards angle and yet avoids the difficulties described hereinabove.

SUMMARY OF THE INVENTION

The above and other objectives are achieved by the innovative method of using a winch and by using the innovative winch mount provided by the present invention.

The use of the teachings of the present invention allows greater extrication ability by removing the force-absorbing fairlead and allowing use of the powerful first wrap of the winch for a longer distance. The use of the teachings of the present invention allows safe winch operation by avoiding cable and vehicular damage. The use of the teachings of the present invention increases the self-extrication ability of a vehicle. By reducing the strain during operation, the lifetime of the winch motor can be prolonged.

According to the teachings of the present invention there is provided a method of operating a winch attached to a first object, the winch being employed to draw the first object and a remote second object together when the second object is off-axis from the first object by more than 2°. The method includes the steps of a) attaching the cable to the second object; b) activating the winch; and c) moving the winch relative to the first object so as to align the winch, so that when the winch is activated, the force exerted by the cable on the winch drum is substantially perpendicular to the drum rotation axis.

According to a further feature of the present invention, the first object on which the winch is attached is vehicle or a nautical vessel.

According to a further feature of the present invention, alignment of the winch includes rotating the winch around an alignment axis, the alignment axis being substantially perpendicular to the drum rotation axis. According to a still further feature of the present invention, the first object on which the winch is attached is a vehicle and the alignment axis is substantially parallel or substantially perpendicular to the surface on which the vehicle stands.

According to a further feature of the present invention, alignment of the winch is performed with the help of a motor.

According to a further feature of the present invention, alignment of the winch is done preceding and/or during operation of the winch in order to maintain the perpendicularity of the force relative to the drum rotation axis throughout operation of the winch.

According to a still further feature of the present invention, a device is provided to determine the direction of the force or to determine the angle of the cable relative to the drum rotation axis.

There is also provided according to the teachings of the present invention a winch mount made up of a mount-base and a winch-holder. The mount-base is attached to some object such as a vehicle. The winch holder is configured to hold the winch in a fixed position, and is rotatably mounted along an alignment axis, the alignment axis being substantially perpendicular to the winch drum rotation axis.

According to a further feature of the present invention, there is provided a alignment mechanism for rotating the winch-holder around the alignment axis, such as a motor, in particular, an electric or a hydraulic motor.

According to a further feature of the present invention, there is provided a winch control unit to simultaneously monitor and regulate activation of the winch and of the alignment mechanism. According to a still further feature of the present invention the winch control unit control includes a computer.

According to a further feature of the present invention, there is provided a remote control mechanism to control the mechanism of rotation, the remote control mechanism including a cable or an infrared or radio frequency transmitter which sends the commands of the operator to a winch control unit.

According to a further feature of the present invention there is provided a device for determining the angle of the force exerted by the cable relative to the winch drum or to determine the angle of the cable relative to the winch drum rotation axis. Further there is provided a mechanism to automatically control the motor to rotate the winch-holder around the alignment axis in accordance with the angle determined by the device.

According to a still further feature of the present invention the device for determining the angle of the force exerted by the cable relative to the winch drum or to determine the angle of the cable relative to the winch drum rotation axis includes a radiation detector, such as a light sensor, or a sensor that measures pressure such as one using a piezoelectric material.

According to a still further feature of the present invention, there is a sensor that determines a magnitude of a force applied parallel to the drum rotation axis.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
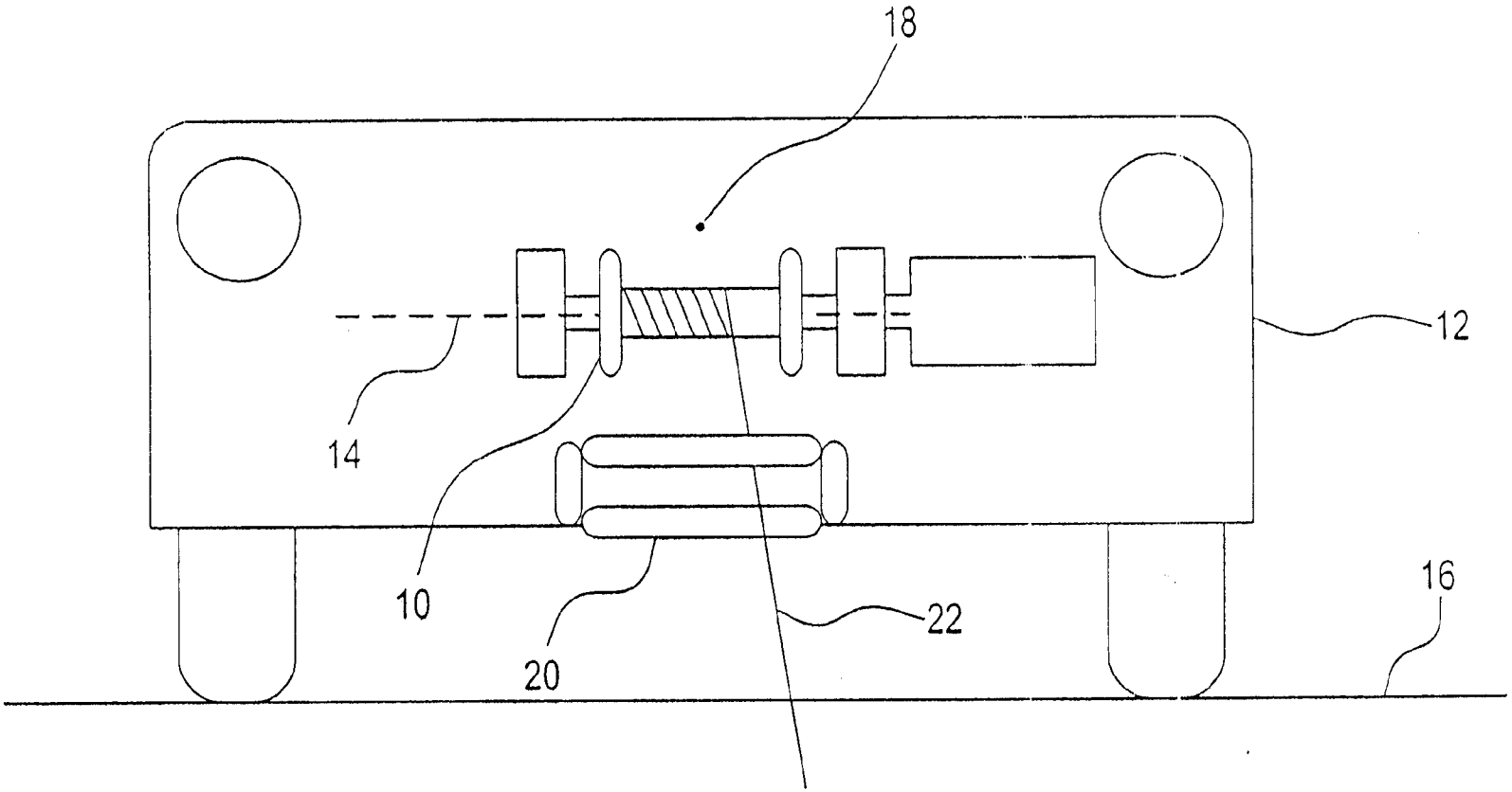
FIG.1 (Prior Art)
FIG. 1 (prior art) shows how a winch is a typically mounted to the front end of a motor vehicle.
Figure 2A:
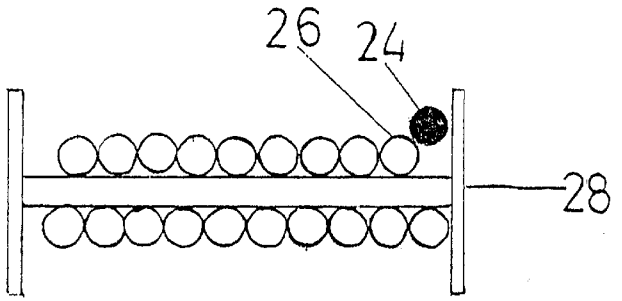
FIGURE 2A (PRIOR ART)
FIGS. 2*a* through 2*c* (prior art) illustrate the manner by which a cable is tightly rewound onto a winch drum.
Figure 2B:
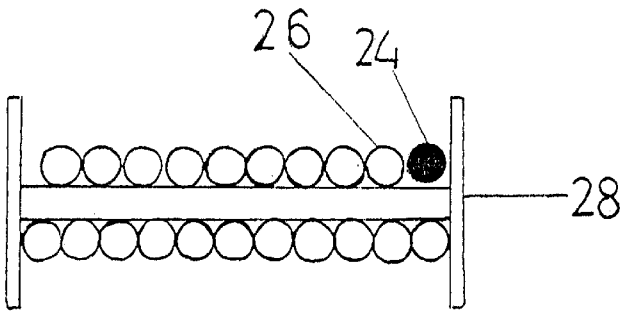
FIGURE 2B (PRIOR ART)
Figure 2C:
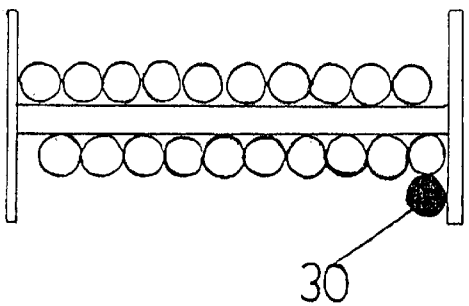
FIGURE 2C (PRIOR ART)
Figure 3A:
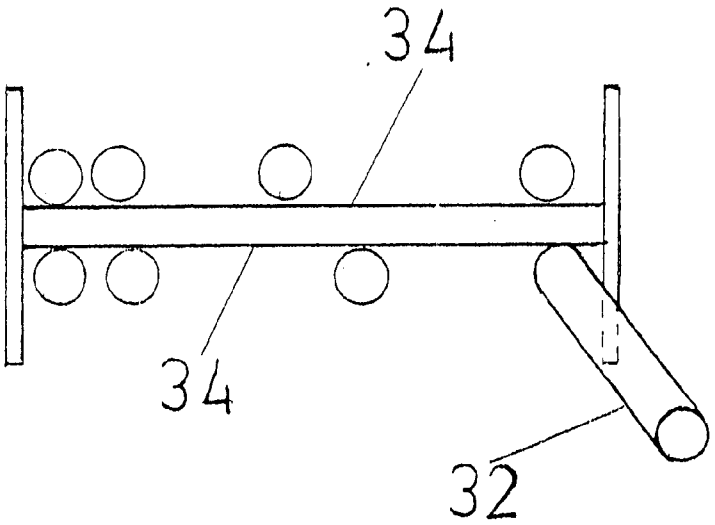
FIGURE 3A (PRIOR ART)
FIGS. 3*a* and 3*b* (prior art) illustrate how a cable is not properly wound if the angle between the cable and the drum rotation axis is far from 90°.
Figure 3B:
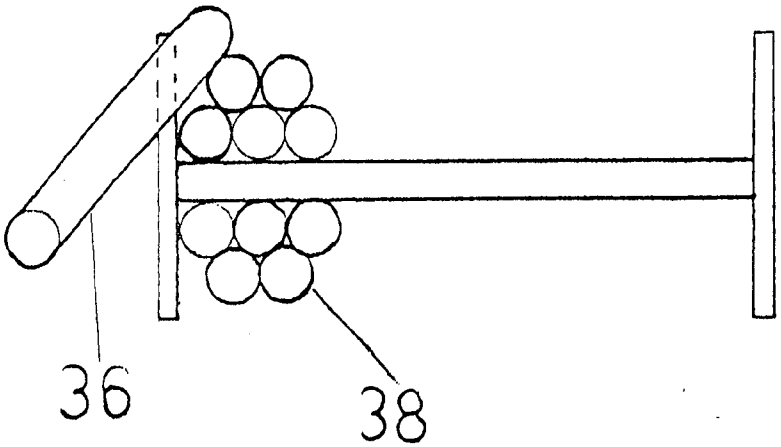
FIGURE 3B (PRIOR ART)

The principles and operation of the present invention may be better understood with reference to the drawings and the accompanying description.

The problem that the present invention addresses occurs when something needs to be pulled with the help of a winch. The winch cable is unwound from the winch drum and attached to some object. The drum rotates when the winch motor is activated, winding the cable until it is taut. At this point the cable describes a substantially straight line between the winch drum and the object. The winch cable exerts a force on the winch drum, the force being substantially collinear with the part of the cable that is adjacent to the winch-drum.

As long as the angle between the force and the drum rotation axis is close to perpendicular, the cable is wound onto the drum in tightly packed wraps, one complete wrap on top of the other. However, when the angle between the force and the drum rotation axis is greater than roughly 2° from perpendicular the cable does not wind onto the drum properly, as described above. A winch is typically mounted on a first object so that the drum rotation axis is substantially perpendicular to an axis of the first object and the cable of the winch is attached to a second object. Thus the present invention is designed to solve the problem arising when the second object is off-axis relative to the first object, that is, it is not found along the axis of the first object.

There exists a proper orientation of the drum rotation axis that ensures proper cable winding. The proper orientation is one where the force exerted by the winch cable is perpendicular to the drum rotation axis.

According to the method of using a winch of the present invention, the winch is moved relative to the object to which it is attached so that the force exerted by the cable is perpendicular to the drum rotation axis throughout the operation of the winch, that is, the winch is moved to achieve the proper orientation. This ensures that the cable is properly wound onto the drum.

It is clear to one skilled in the art that when a winch is used, the angle of the cable and thus of the force relative to the drum rotation axis can change during the pulling operation. Thus, it is highly advantageous to use the teachings of the present invention to maintain perpendicularity of the force relative to the drum rotation axis throughout the pulling activity by moving the winch relative to the object to which it is attached in such a way so as to maintain the proper orientation.

The present invention also provides a winch mount that can be used to apply the method of the present invention. In one embodiment of the winch mount of the invention, FIG. 4*a,* the winch mount is used to mount a winch 40 to the front of a vehicle 42 resting on underlying surface 44. The winch mount, constructed in accordance with the teachings of the present invention, is made up of a mount-base 46 and a winch-holder 48. Winch-holder 48 is configured to hold winch 40 in a fixed position relative to winch-holder 48. Winch-holder 48 is attached rotatably along an alignment axis 50 to mount-base 52, alignment axis 50 being substantially perpendicular to drum rotation axis 54. Alignment axis 50 is furthermore substantially parallel to underlying surface 44.

When operation of winch 40 is required, the loose end of cable 56 is attached to object 58. The operator rotates winch-holder 48 together with winch 40 around alignment axis 50 so that drum rotation axis 54 is substantially perpendicular to cable 56, as depicted in FIG. 4*b*. The force (exerted by cable 56 on the winch drum) and cable 56 are substantially collinear adjacent to drum rotation axis 54. Therefore, the orientation depicted in FIG. 4*b* is the proper orientation according to the method of the present invention. It is clear to one skilled in the art that winch-holder 48 together with winch 40 can be rotated around alignment axis 50 at any time, especially preceding the attachment of cable 56 to object 58 in order to achieve the proper orientation of drum rotation axis 54.

Figure 4A:
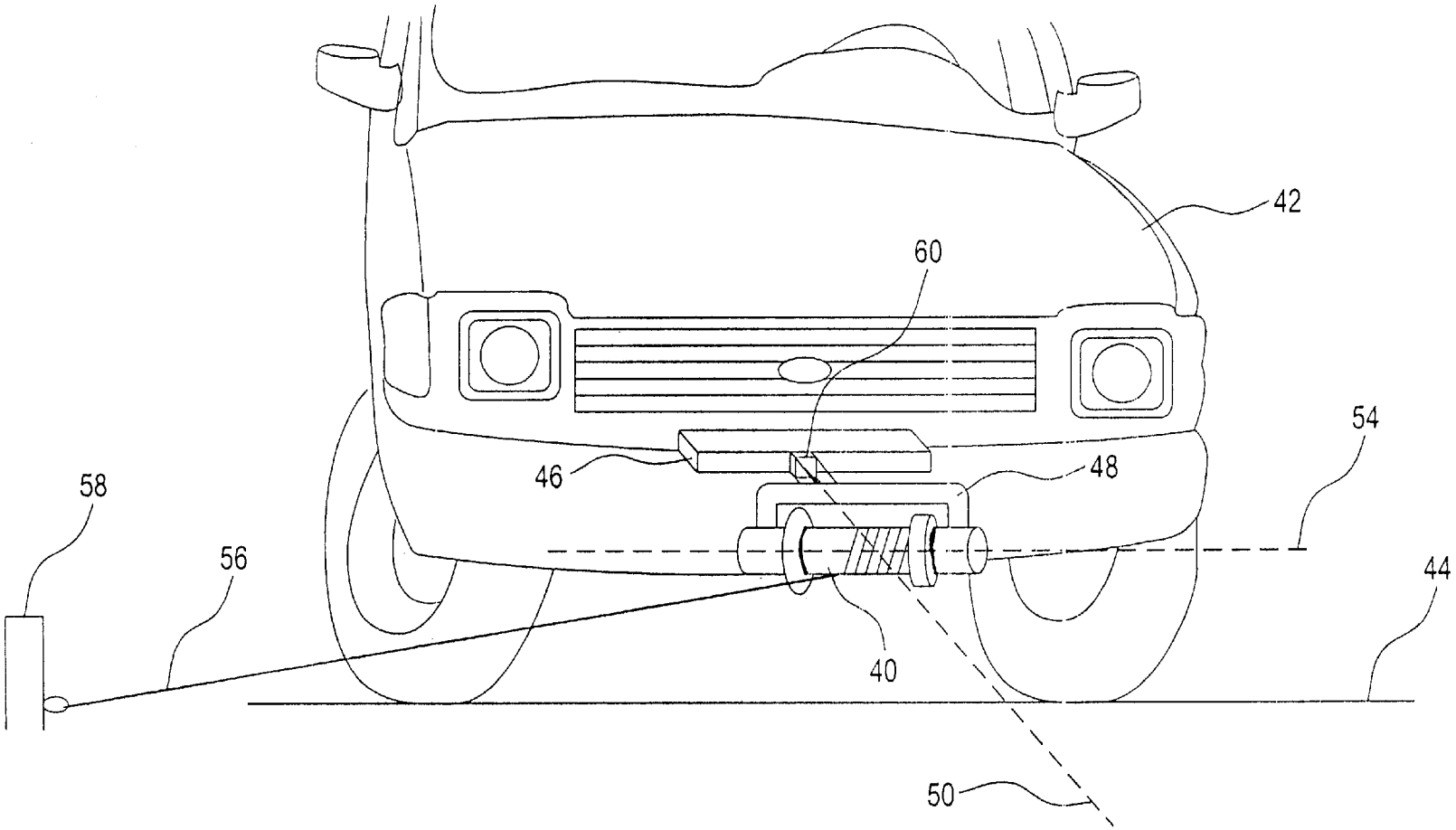
FIGS. 4*a* and 4*b* is an embodiment of a winch mount as provided by the present invention wherein the alignment axis is parallel to the underlying surface.
Figure 4B:
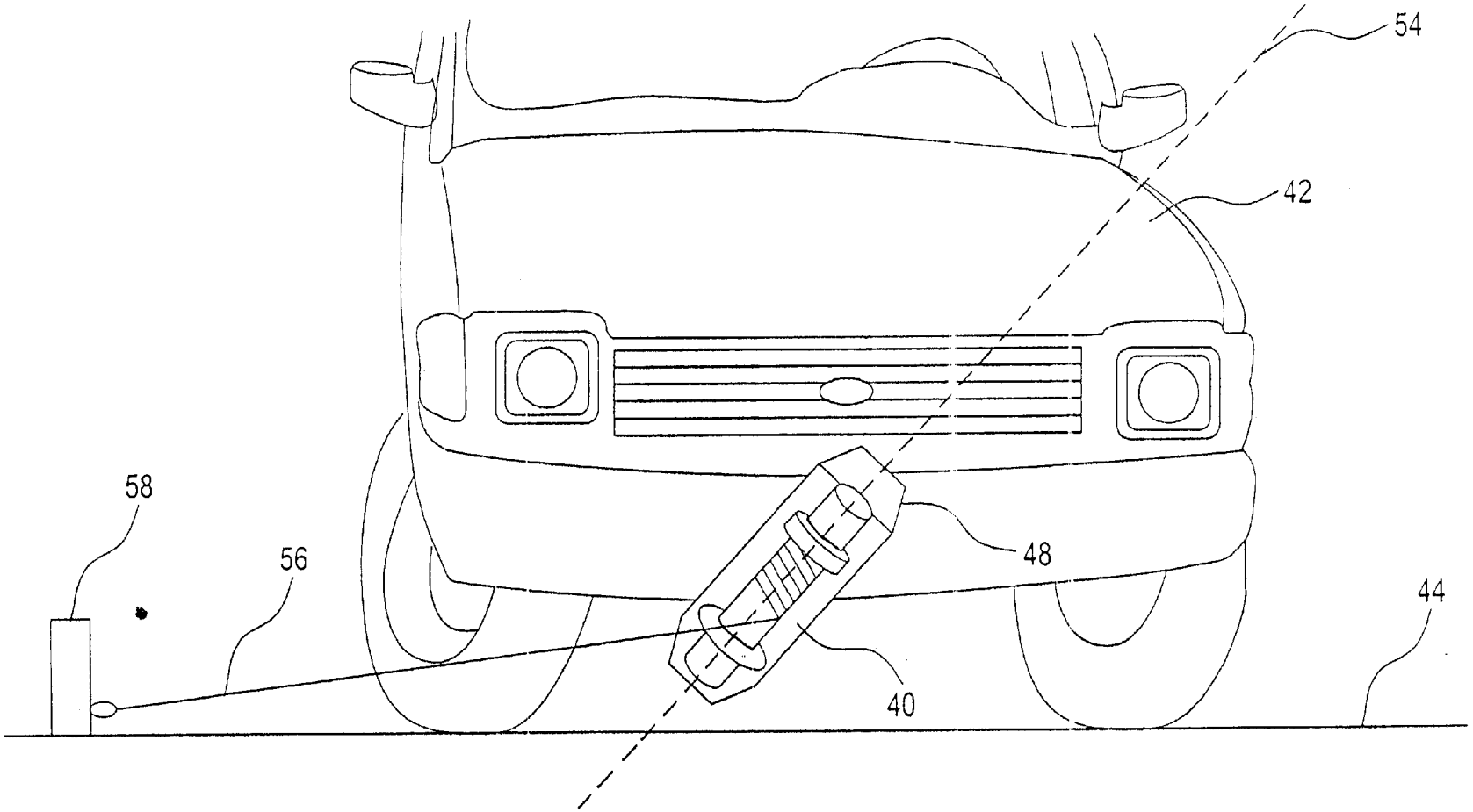

In order to ensure that the proper orientation is maintained once fixed by the operator, the embodiment of the present invention depicted in FIG. 4*a* includes a locking mechanism 60.

Figure 5:
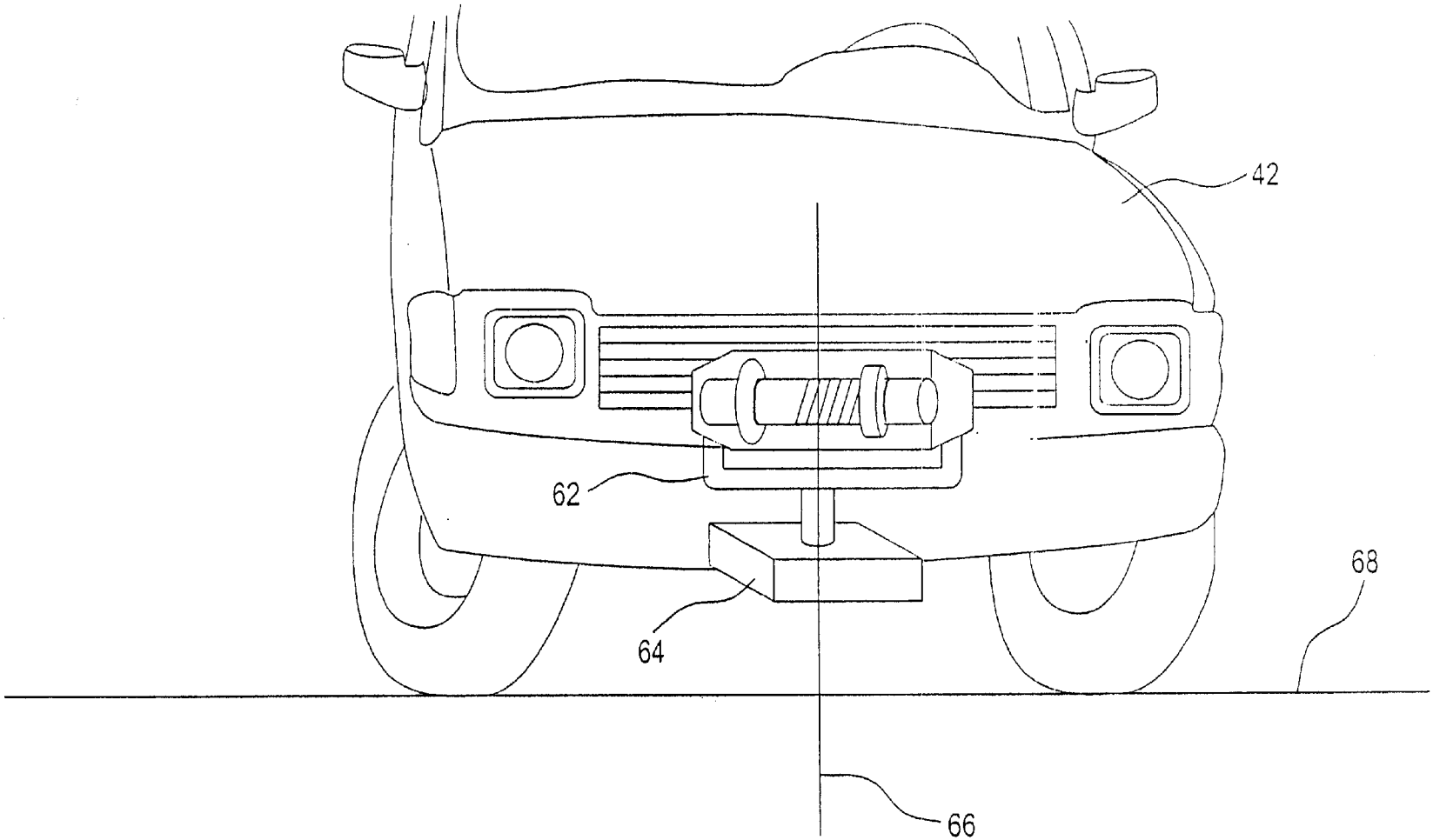
FIG. 5 is an embodiment of a winch mount as provided by the present invention wherein the alignment axis is perpendicular to the underlying surface.

In another embodiment of the present invention, depicted in FIG. 5, winch-holder 62 is attached to mount-base 64 so that alignment axis 66 is substantially perpendicular to underlying surface 68.

During winch operation the angle between the cable and the winch can change, changing the direction of the force relative to the drum rotation axis. Thus, in a preferred embodiment of the present invention, depicted in FIG. 6, a motor 70 is provided. When activated, motor 70 rotates winch-holder 72 together with winch 74 relative to mount-base 76. Motor 70 can be activated at any time to ensure that drum rotation axis 78 is oriented properly. This includes activation of motor 70 during the pulling operation to rotate winch-holder 68 continuously or intermittently to maintain the proper orientation. Motor 70 is most preferably an electric motor.

It is clear to one skilled in the art that in some embodiments of the device of the present invention there must also be a mechanism to transfer motor rotation to the alignment axis. Such mechanisms are well known to one skilled in the art and are not described further herein.

For safety reasons, winches are often equipped with a remote control to allow operation of the winch from a safe distance. The remote control incorporates control of winch operation, drum rotation direction and when applicable, winding speed. A long control cable most often connects the remote controls known in the art to the vehicle or to the winch.

Figure 6A:
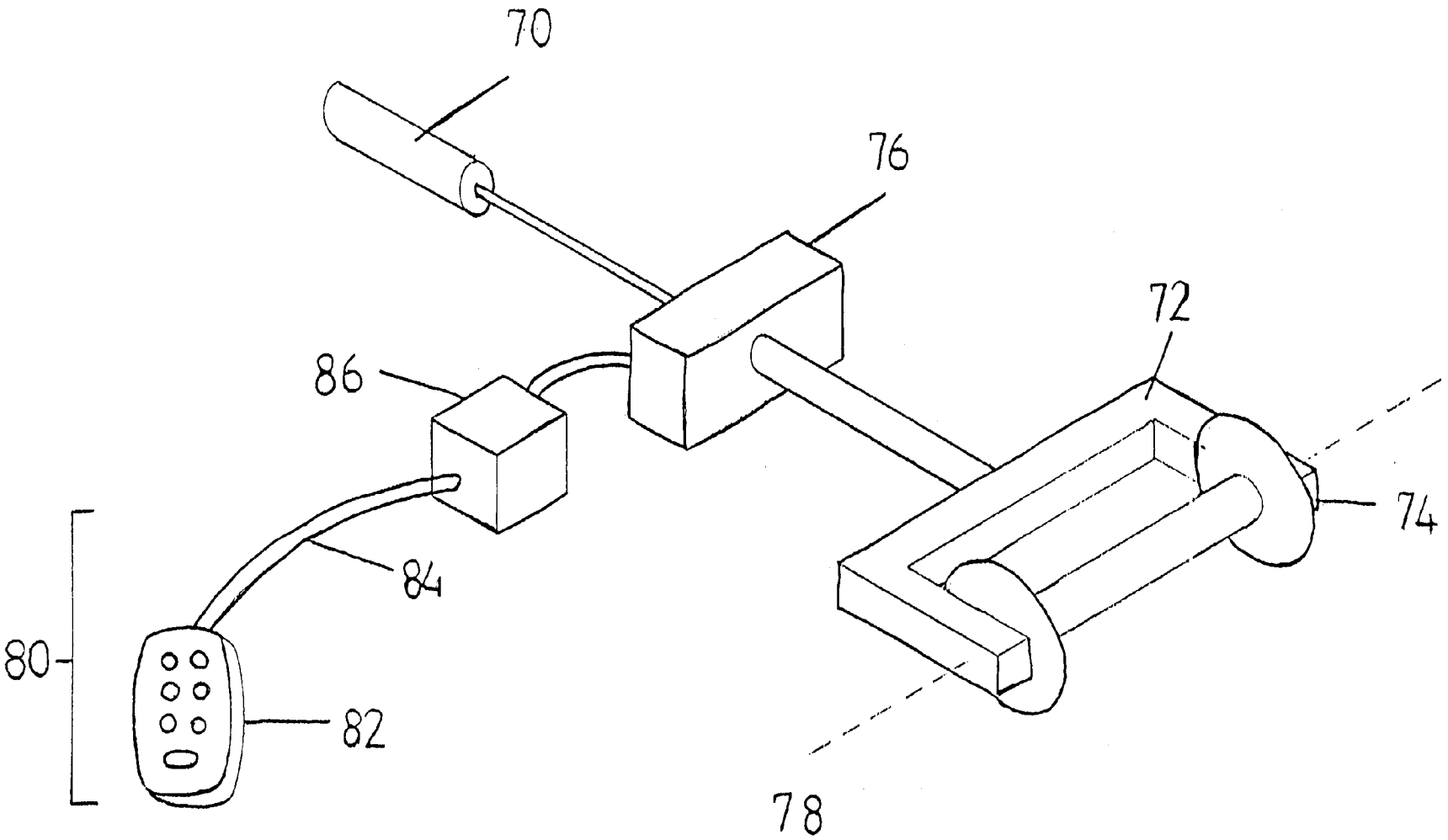
FIG. 6 is an embodiment of a winch mount with an electric motor and a remote control as provided by the present invention.
Figure 6B:
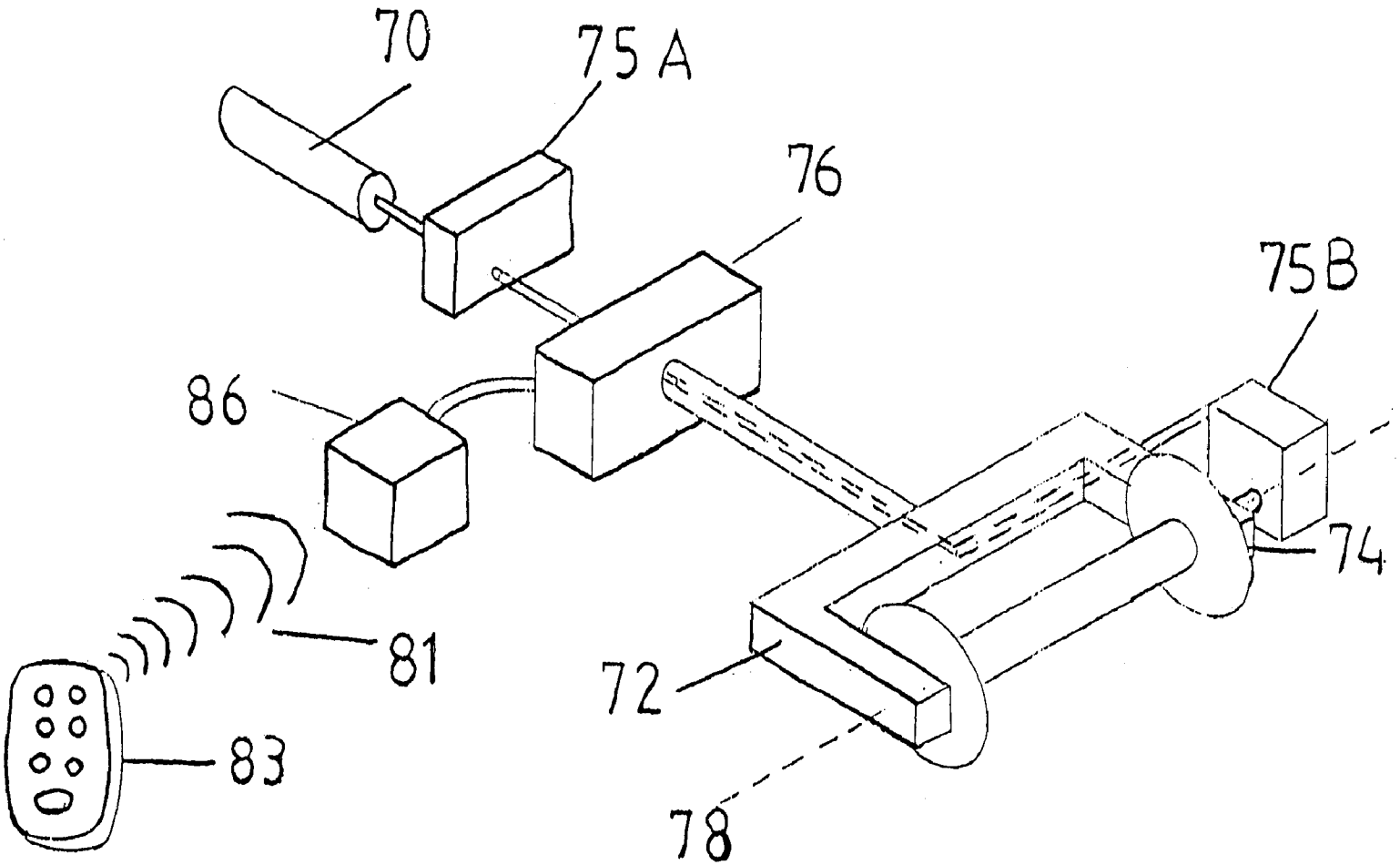
Figure 6C:
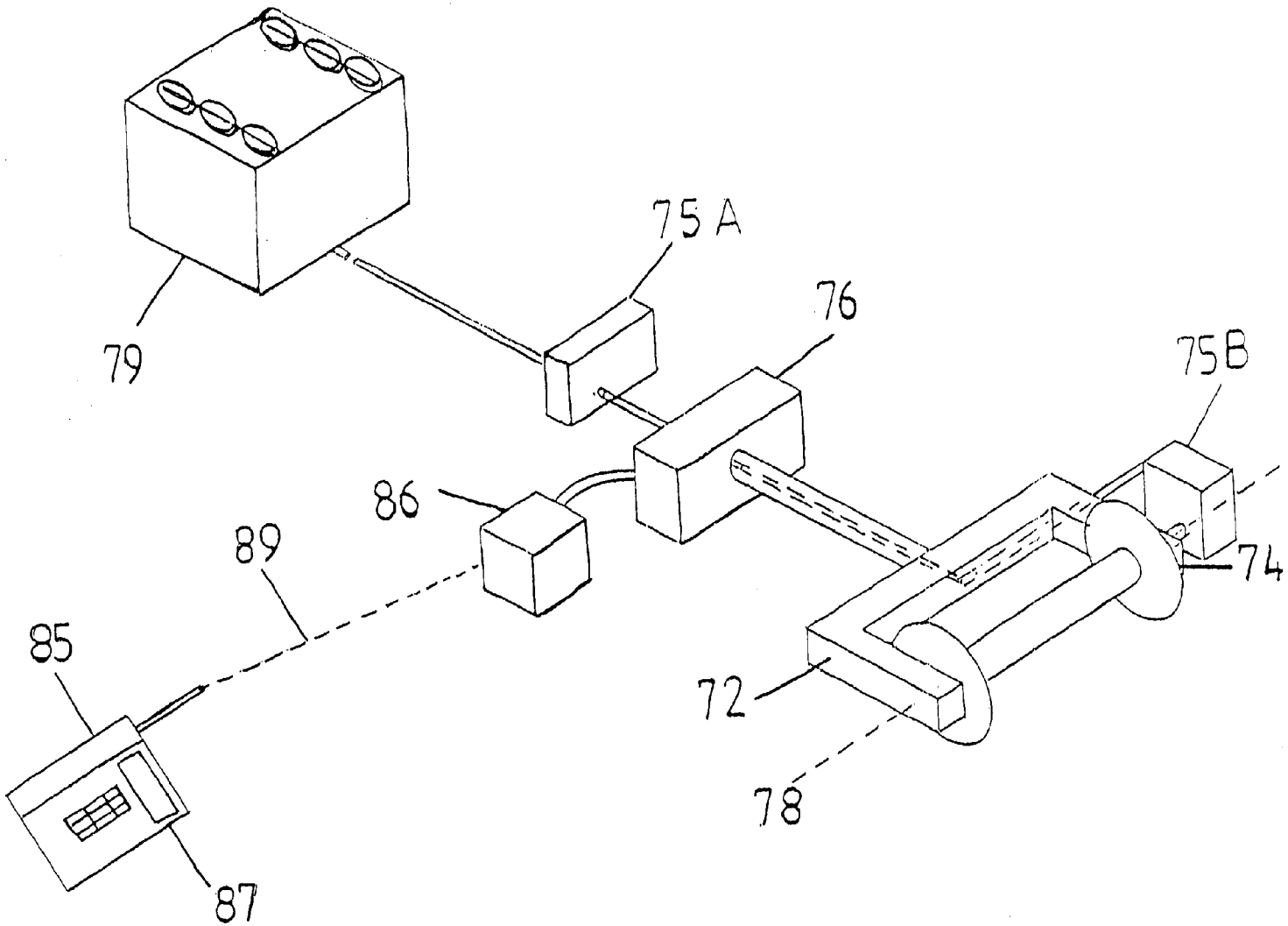

In the embodiment of the present invention depicted in FIG. 6, a remote control 80 is supplied, which in addition to its winch-controlling function, is further configured to control motor 70 and therefore the rotation of winch-holder 72 relative to mount-base 76. Such a remote control can be realized using infrared radiation as is often used in remote-control units of televisions or a radio frequency radiation transmitter. In FIG. 6, remote control 80 is made up of a portable control unit 82 attached through a control cable 84 to a winch control unit 86. The operator uses portable control unit 82 to transfer commands through control cable 84 to winch control unit 86. Winch control unit 86 is configured to activate motor 70 to rotate winch-holder 72 relative to mount-base 74 in accordance with the commands of the operator.

Figure 7:
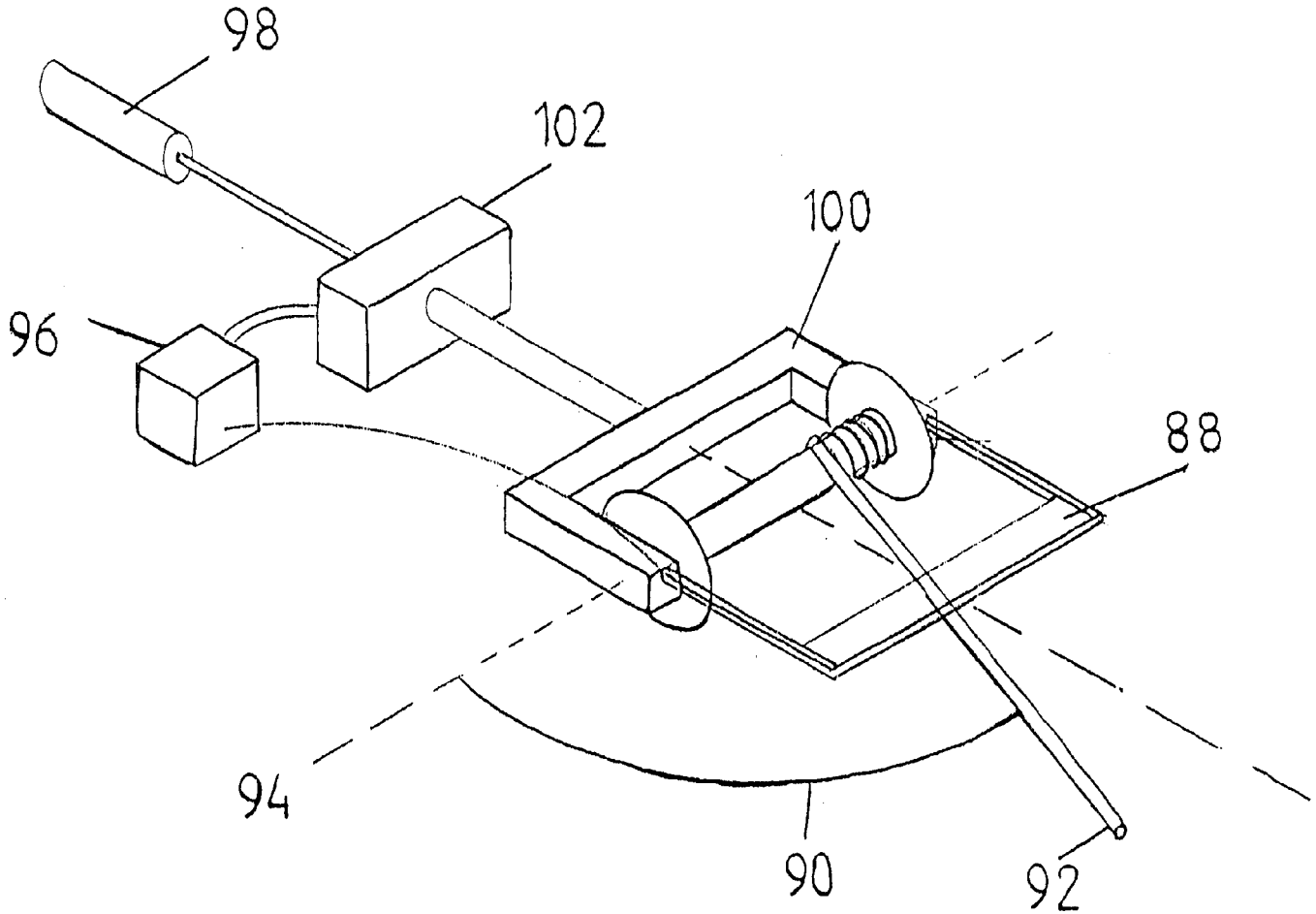
FIG. 7 is an embodiment of a winch mount with an electric motor and an automatic cable-direction sensor as provided by the present invention.

It is advantageous to automatically rotate the winch-holder relative to mount-base in order to maintain the desired angle between the drum rotation axis and the cable, without user intervention. Thus an even more preferred embodiment of the present invention, FIG. 7, includes a sensor 88 configured to determine angle 91 of cable 92 relative to drum rotation axis 94 and to supply this information to a winch control unit 96. Since in close proximity to drum rotation axis 94 the force (exerted by cable 92 on drum rotation axis 94) and cable 92 are substantially collinear, determination of angle 90 gives a good indication of the direction of the force. Winch control unit 96 can then cause a motor 98 to rotate winch-holder 100 relative to mount-base 102 in the direction and to the degree necessary for optimum practice of the teachings of the present invention. It is advantageous to monitor parameters of the speed of and stress of the winch and motor 98 when these are simultaneously operated and to regulate the operation of the winch and motor 98 for optimal use of the present invention. In a most preferred embodiment, winch control unit is configured to monitor and regulate the simultaneous operation of the winch and motor 98. Winch control unit 96 preferably includes a computer.

A large number of methods and devices can be used to detect the angle of the cable or of the force vector it exerts relative to the rotating axis of the winch.

Figure 8:
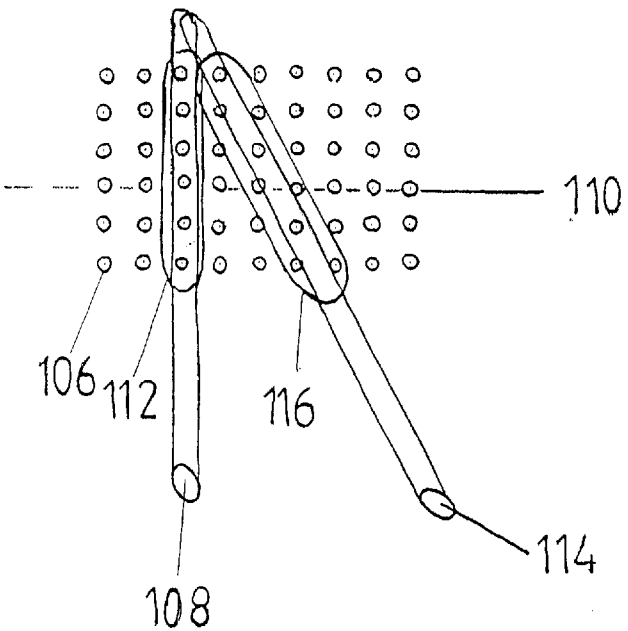
FIG. 8 is an embodiment of a cable-direction sensor using a matrix of light sources and light detectors as provided by the present invention.

In one embodiment of the present invention, FIG. 8, a two-dimensional array of light sources (not illustrated) such as light emitting diodes is installed along with a complementary matrix 104 of light detectors 106 placed appropriately in the vicinity of the cable. When the cable is substantially perpendicular 108 to drum rotation axis 110, a certain group of detectors 112 detects light reflected from cable 108. When the cable is at a different angle 114 to drum rotation axis 110, a different group of detectors 116 detects light reflected from cable 114. Analysis of which group of light detectors detects light reflected from the cable allows determination of the angle of the cable relative to the drum rotation axis at any given moment.

In another embodiment of the present invention, the device used to detect the angle of the cable relative to the drum rotation axis is based on using a pressure-sensitive sensor. By measuring the forces generated by the pulling operation at a given place, the direction of the force that the cable exerts relative to the drum rotation axis can be determined. One type of pressure sensitive sensor makes use of a piezoelectric material to generate an electrical field, the strength of the field being proportional to the magnitude of the force applied to the piezoelectric material.

Figure 9:
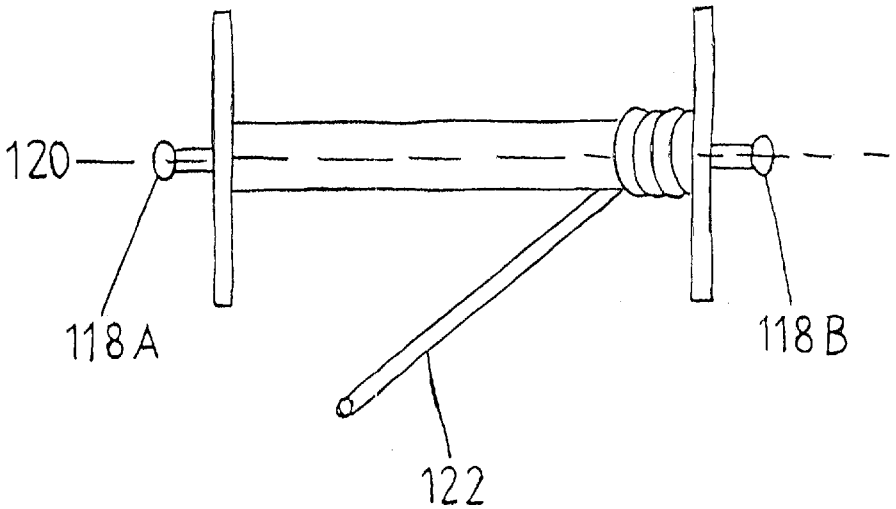
FIG. 9 is an embodiment of a cable-direction sensor using two piezoelectric devices embedded in the drum axis as provided by the present invention.

In an additional embodiment of the present invention depicted in FIG. 9, two piezoelectric pressure sensors, 118*a* and 118*b,* are embedded at either end of drum rotation axis 120 in such a way as to be able to measure the forces applied along drum rotation axis 120. These forces are the components of the force exerted by the cable that are perpendicular to drum rotation axis 120. When sensors 118*a* and 118*b* detect unequal forces, cable 122 is not perpendicular to drum rotation axis 120. When sensors 118*a* and 118*b* detect equal forces, cable 122 is necessarily perpendicular to drum rotation axis 120. This information can be transferred to the winch control unit.

Figure 10:
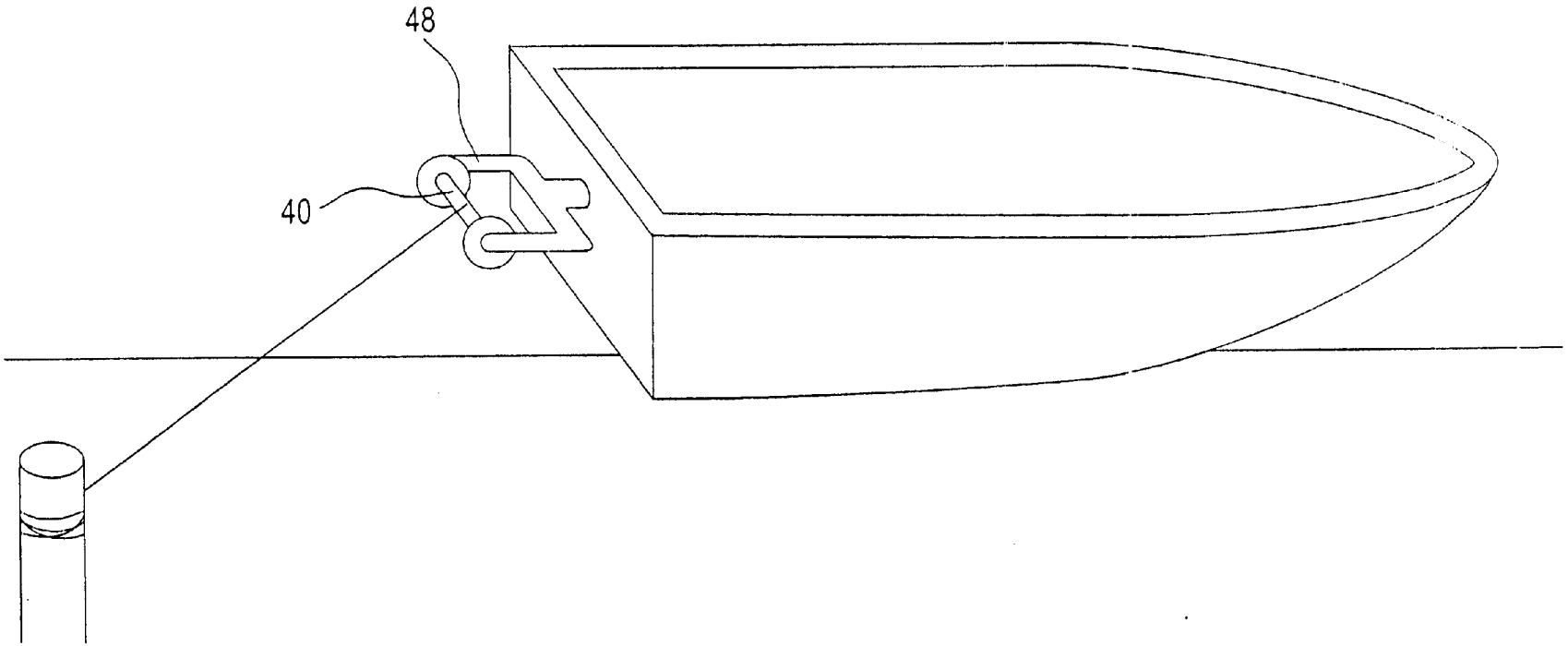
FIG. 10 is an embodiment of a winch mount as provided by the present invention mounted to a nautical vessel.

Although the present invention has been described with reference to use with motor vehicles, the teachings of the present invention can applied wherever winches are used such as in nautical (FIG. 10) and aviation applications.

It is clear to one skilled in the art that the invention is not limited to the embodiments described herein but also relates to all modifications thereof, insofar as they are within the scope of the claims.

What is claimed is:

1. A method of operating a winch attached to a first object, the first object having a main axis and the winch having a drum, a drum rotation axis and a cable, the winch being employed to draw the first object and a remote second object together when the second object is off-axis from the first object by more than 2°, the method comprising the steps of:

a) attaching the cable to the second object;

b) activating the winch; and c) moving the winch relative to the first object so as to align the winch, so that when the winch is activated, a force exerted by the cable on the drum is substantially perpendicular to the drum rotation axis wherein said alignment includes rotating the winch around an alignment axis, said alignment axis being substantially perpendicular to the drum rotation axis.

2. The method of claim 1 wherein said first object is a nautical vessel.

3. The method of claim 1 wherein said first object is a vehicle.

4. The method of claim 1 wherein said first object is a vehicle resting on an underlying surface and wherein said alignment axis is substantially parallel to said underlying surface.

5. The method of claim 1 wherein said first object is a vehicle resting on an underlying surface and wherein said alignment axis is substantially perpendicular to said underlying surface.

6. The method of claim 1 wherein said aligning of the winch is performed with the use of a motor.

7. The method of claim 1 wherein the step of aligning the winch is performed during said operation of the winch to maintain the perpendicularity of said force relative to the drum rotation axis throughout said operation of the winch.

8. The method of claim 7 further comprising the step of providing a device configured to determine a direction of said force relative to the drum rotation axis.

9. The method of claim 7 further comprising the step of providing a device configured to determine the angle of the cable relative to the drum rotation axis.

10. The method of claim 1 wherein the step of aligning the winch precedes said operation of the winch.

11. A winch mount for mounting a winch with a cable and a drum rotation axis, the winch mount comprising:

a) an object having a mount-base, said object supported by a surface;

b) a winch-holder configured to hold the winch in a fixed position relative to said winch-holder and rotatably attached to said mount-base along an alignment axis, where rotation of said winch-holder relative to said mount-base around said alignment axis is substantially perpendicular to the drum rotation axis and wherein said alignment axis is substantially parallel to the surface.

12. The winch mount of claim 11 further comprising an alignment mechanism for rotating said winch-holder around said alignment axis.

13. The winch mount of claim 12 further comprising a winch control unit, configured to regulate activation of said alignment mechanism.

14. The winch mount of claim 13 wherein said winch control unit includes a computer means.

15. The winch mount of claim 13 wherein said winch control unit is further configured to monitor and regulate activation of the winch and of said alignment mechanism simultaneously.

16. The winch mount of claim 12 wherein said alignment mechanism includes a remote-control mechanism configured to control rotation of said winch-holder around said alignment axis and includes a winch control unit, said winch control unit configured to control rotation of said winch-holder.

17. The winch mount of claim 16 wherein said remote-control mechanism includes a portable control unit and a control cable, said control cable configured to connect said portable control unit to said winch control unit.

18. The winch mount of claim 16 wherein said remote-control mechanism includes a transmitter of infrared radiation.

19. The winch mount of claim 16 wherein said remote-control mechanism includes a transmitter of radio-frequency radiation.

20. The winch mount of claim 19 further comprising a device configured to determine an angle of the drum rotation axis relative to a component of a force exerted by the cable on the drum rotation axis.

21. The winch mount of claim 20 wherein said device includes a piezoelectric material.

22. The winch mount of claim 20 wherein said device includes a sensor configured to determine a magnitude of a force parallel to the drum rotation axis.

23. The winch mount of claim 12 wherein said alignment mechanism includes a motor.

24. The winch mount of claim 23 wherein said motor is an electric motor.

25. The winch mount of claim 23 wherein said motor is a hydraulic motor.

26. The winch mount of claim 23 further comprising a device configured to determine an angle of the cable relative to the drum rotation axis.

27. The winch mount of claim 26 wherein said device includes a radiation detector.

* * * * *